US011828031B2

(12) United States Patent
Weihl

(10) Patent No.: US 11,828,031 B2
(45) Date of Patent: Nov. 28, 2023

(54) PLOW ASSEMBLY LINKAGE

(71) Applicant: Ricky A. Weihl, Muskegon, MI (US)

(72) Inventor: Ricky A. Weihl, Muskegon, MI (US)

( * ) Notice: Subject to any disclaimer, the term of this patent is extended or adjusted under 35 U.S.C. 154(b) by 360 days.

(21) Appl. No.: 17/098,733

(22) Filed: Nov. 16, 2020

(65) Prior Publication Data

US 2021/0156100 A1 May 27, 2021

Related U.S. Application Data

(60) Provisional application No. 62/940,590, filed on Nov. 26, 2019.

(51) Int. Cl.
*E01H 5/06* (2006.01)

(52) U.S. Cl.
CPC ..... *E01H 5/063* (2013.01); *E01H 5/062* (2013.01)

(58) Field of Classification Search
CPC ..... E01H 5/062; E01H 5/063
See application file for complete search history.

(56) References Cited

U.S. PATENT DOCUMENTS 2,290,060 A * 7/1942 Massey ..... E01H 5/061 37/231
2,775,830 A 1/1957 Kenyon
3,014,289 A 12/1961 Torrey
3,086,303 A 4/1963 Weeks
3,217,431 A 11/1965 Heinzroth et al.
3,250,026 A 5/1966 Jocher et al.
3,422,553 A 1/1969 Holloway
4,187,624 A 2/1980 Blau
4,307,523 A 12/1981 Reissinger et al.
4,439,939 A 4/1984 Blau
4,530,406 A * 7/1985 Hake ..... A01B 61/046 172/708
4,794,710 A 1/1989 Häring
4,843,744 A * 7/1989 Jansen ..... E01H 5/063 37/231
5,044,098 A 9/1991 Berghefer
5,088,215 A * 2/1992 Ciula ..... E01H 5/063 37/197
5,109,618 A * 5/1992 Grubler ..... E01H 5/063 403/328
5,191,729 A 3/1993 Verseef
5,437,113 A 8/1995 Jones
5,697,172 A 12/1997 Verseef
5,787,992 A * 8/1998 Dobson ..... A01B 61/046 172/705
5,802,746 A * 9/1998 Miller ..... E01H 5/065 37/232
5,901,793 A * 5/1999 Frisbee ..... E02F 3/844 172/816
6,701,646 B2 3/2004 Schultz et al.
7,171,770 B2 2/2007 Schultz et al.
7,543,401 B2 6/2009 Hughes
8,499,477 B2 8/2013 Gamble, II
8,832,974 B2 9/2014 Koch et al.
9,051,700 B2 6/2015 Summers et al.
(Continued)

*Primary Examiner* — Gary S Hartmann
(74) *Attorney, Agent, or Firm* — Warner Norcross + Judd LLP

(57) ABSTRACT

A linkage for an implement is provided for connection to a vehicle. The linkage may be configured to allow extension of the linkage along its longitudinal axis, with a spring under tension that urges the linkage toward a primary operating position.

13 Claims, 11 Drawing Sheets

(56) References Cited

U.S. PATENT DOCUMENTS

| | | | | |
|---|---|---|---|---|
| 10,150,428 | B2 | 12/2018 | Weihl | |
| 10,412,875 | B2 * | 9/2019 | Kovach | A01B 35/24 |
| 11,208,777 | B2 * | 12/2021 | Briggs | E01H 5/063 |
| 2005/0120594 | A1 | 6/2005 | Hollinrake et al. | |
| 2015/0033589 | A1 | 2/2015 | McAdam et al. | |
| 2015/0101216 | A1 | 4/2015 | Kerr et al. | |
| 2022/0010512 | A1 * | 1/2022 | Duchesneau | E01H 5/067 |

* cited by examiner

PLOW ASSEMBLY LINKAGE

FIELD OF INVENTION

The present disclosure relates to a plow assembly, and more particularly to a linkage for a snow plow assembly.

BACKGROUND

Linkages are used in a variety of applications, and have been found to be of particular interest in the realm of coupling an implement to a vehicle. Implements such as snow plows are often coupled to a vehicle via a plurality of linkages or actuators, or a combination thereof. The linkages and actuators may enable an operator to raise and lower the implement for engagement with a ground surface. For instance, for a snow plow, linkages in conjunction with one or more actuators may both couple the snow plow to the vehicle and enable an operator to raise the snow plow for travel between sites and to lower the snow plow to engage a ground surface, such as a parking lot or a driveway, and facilitate snow removal therefrom.

When plowing a ground surface, it is possible for the lower edge or ground contacting portion of the plow to encounter an obstruction. Conventionally, due to the rigid manner in which the linkages and actuator couple the vehicle to the plow, encountering such obstruction can damage portions of the plow or vehicle. Obstructions are of particular concern when the ground surface is obscured by snow so that an obstruction may go unnoticed by the operator.

In some cases, a conventional plow may include an articulating blade that allows a portion of the blade to pivot relative to the remaining portion of the blade. This way, the conventional plow may yield somewhat in response to encountering an obstruction and try to avoid damage due to the encounter. The downside of such an articulating blade is that both the cost to manufacture and maintain the plow are often greater relative to a plow with a fixed blade construction.

SUMMARY

A linkage for an implement is provided for connection to a vehicle. The linkage may be configured to allow extension of the linkage along its longitudinal axis, with a spring under tension that urges the linkage toward a primary operating position.

A linkage for a plow assembly in accordance with one embodiment is provided. The linkage may include a first elongate member, a second elongate member, and a spring element. The first elongate member may include a first linkage coupler, which may be operable to join with a first coupler of the plow assembly. The first linkage coupler may be disposed proximal to a first end of the linkage. The second elongate member may include a second linkage coupler, which may be operable to join with a second coupler of the plow assembly. The second linkage coupler may be disposed proximate to a second end of the linkage opposite the first end.

The spring element of the linkage may be coupled to each of the first and second elongate members, and operable to urge the first linkage coupler toward the second linkage coupler to a primary operating position. The spring element may be operable to permit movement of the first linkage coupler to move relative to the second linkage coupler. Such movement may involve displacement from the primary operation position to a breakaway position or trip position.

In one embodiment, a linkage for a plow assembly is provided with a first elongate member, a second elongate member, and a spring element. The first elongate member may include a first linkage coupler, which may be operable to join with a first coupler of the plow assembly. The first linkage coupler may be disposed proximal to a first end of the linkage. The second elongate member may include a second linkage coupler, which may be operable to join with a second coupler of the plow assembly. The second linkage coupler may be disposed proximate to a second end of the linkage opposite the first end. The spring element may include first and second spring element ends coupled respectively to the first and second elongate members, and may be under tension between the first and second ends.

A support assembly mountable to a vehicle and operable to support a plow is provided in one embodiment. The support assembly may include a support structure, a first linkage, and a breakaway linkage. The support structure may be configured to be coupled to the vehicle, and the first linkage may be connected to the support structure.

In one embodiment, the breakaway linkage may be connected to the support structure, and may include a first end connected to the support structure and a second end distal from the first end. The breakaway linkage may include a spring element provided under tension to urge the second end toward the first end, where, in response to the plow encountering an obstruction, the second end extends away from the first end by stretching the spring element.

In one embodiment, a linkage assembly for a plow assembly is provided. The linkage assembly may include a first elongate member and a second elongate member. The first elongate member may include a first linkage coupler, and may be operable to join with a first coupler of the plow assembly. The first linkage coupler may be disposed proximal to a first end of the linkage assembly. The second elongate member may include a second linkage coupler, and may be operable to join with a second coupler of the plow assembly. The second linkage coupler may be disposed proximate to a second end of the linkage assembly opposite the first end.

The linkage assembly may include a spring element operable, in compression, to urge the first linkage coupler toward the second linkage coupler to a primary operating position. The spring element may be operable to permit movement of the first linkage coupler relative to the second linkage coupler, and may include an internal space in which at least a first portion of the first elongate member is provided and in which at least a second portion of the second elongate member is provided.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION

Figure 1:
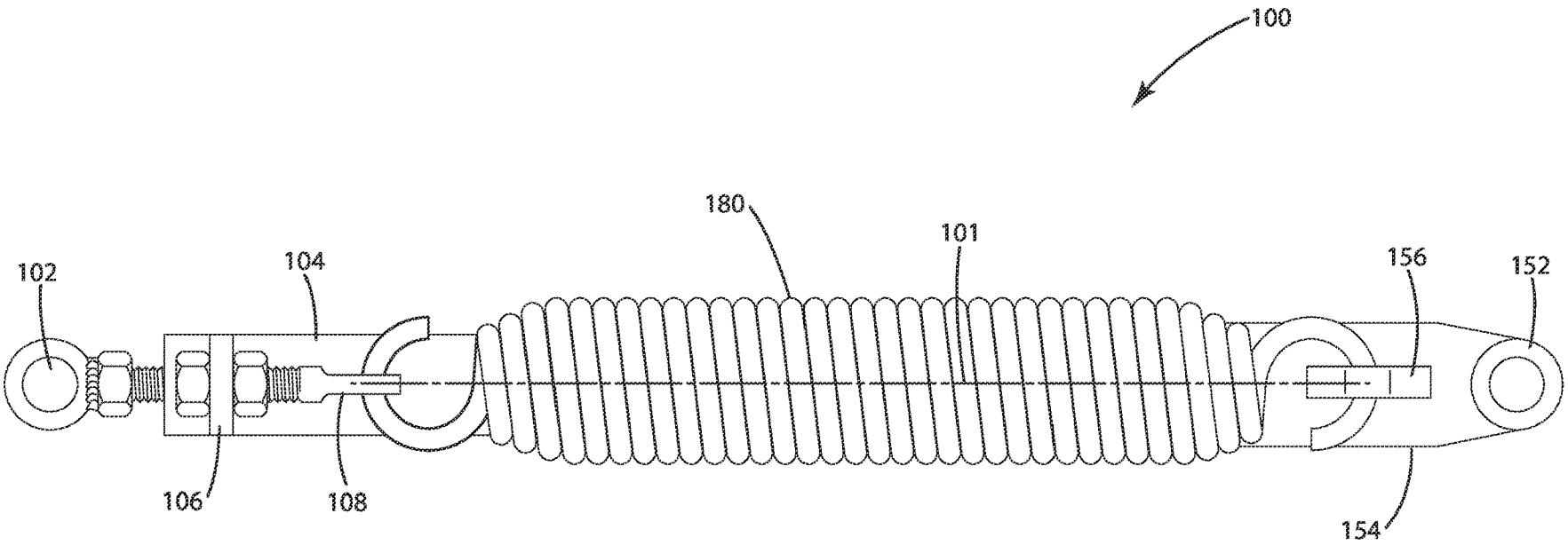
FIG. 1 shows a top view of a linkage in accordance with one embodiment.
Figure 2:
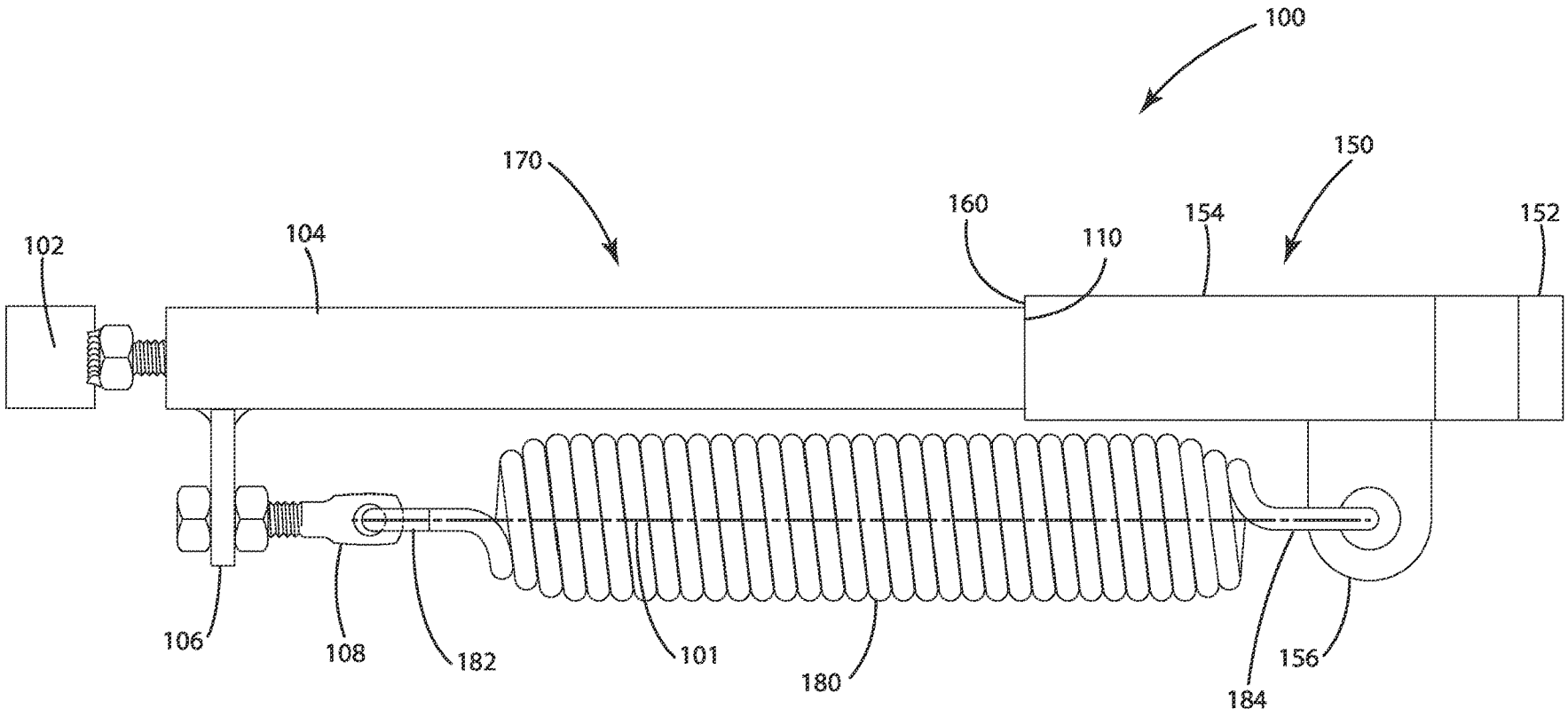
FIG. 2 shows a side view of the linkage of FIG. 1.
Figure 3:
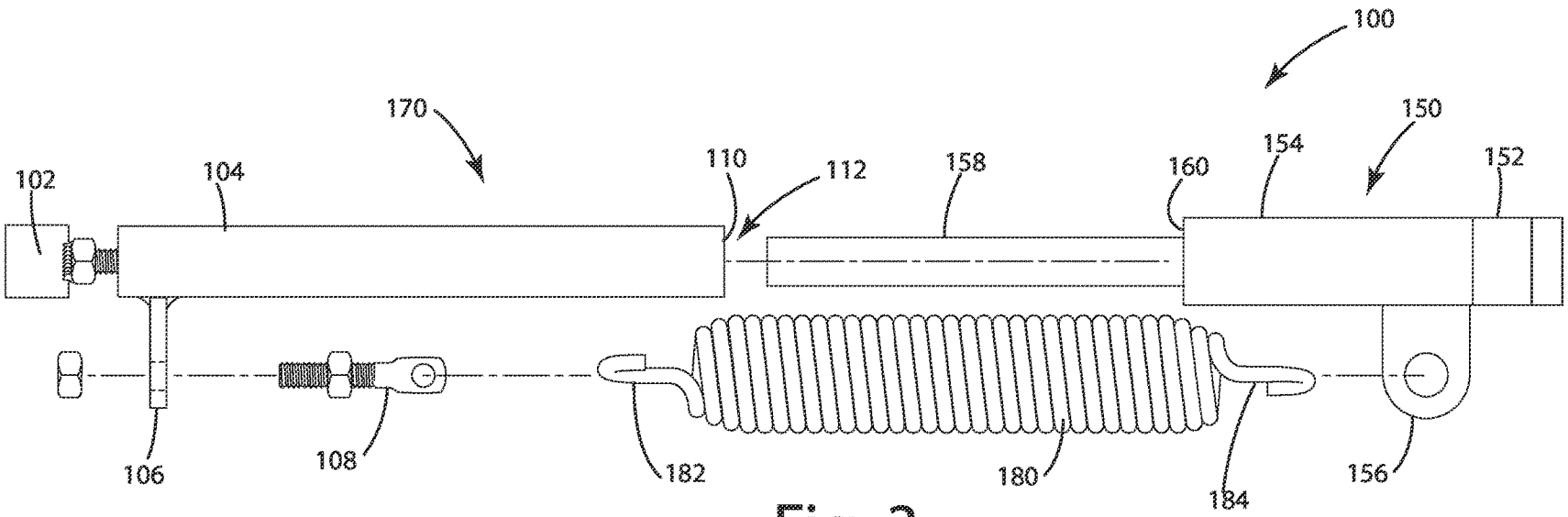
FIG. 3 shows an unassembled view of the linkage of FIG. 1.

A linkage for an implement, which can be coupled to a vehicle, in accordance with one embodiment is configured to allow extension of the linkage along its longitudinal axis, with a spring under tension that urges the linkage toward a primary operating position. It is noted that a linkage in accordance with one or more embodiments described herein is not limited to a particular type of implement or vehicle; indeed, the linkage may be used in any type of application, even applications outside the realm of vehicles.

In the illustrated embodiment of FIGS. 1-6, a linkage in accordance with one embodiment is shown and generally designated 100. The linkage 100 includes a longitudinal axis 101 extending between first and second end portions, with a first linkage coupler 102 disposed proximal to the first end portion and a second linkage coupler 152 disposed proximal to the second end portion. The first linkage coupler 102 and the second linkage coupler 152 may include openings 120, 153 capable of accepting a pin or other member to facilitate engagement to a corresponding coupler, such as a coupler disposed on a support assembly for a plow or the plow itself.

The first linkage coupler 102 in the illustrated embodiment may be connected to the linkage 100 via an adjustable connection including a coupler connector 123 and a member connector 122, such as a threaded bolt and a threaded nut. The adjustable connection may allow rotation of the first linkage coupler 102 relative to the main portion of the linkage 100 in order to align the first linkage coupler 102 with another coupler for connection thereto. The adjustable connection may also enable adjustment of the overall length of the linkage 100 (e.g., by unthreading the bolt, the length of the linkage 100 may be increased).

The coupler connector 123 of the adjustable connection in the illustrated embodiment may include a threaded bolt that is connected to the first linkage coupler 102, such as by welding the first linkage coupler 102 to the coupler connector 123 (e.g., a head of a bolt provided as a coupler connector 123). In the illustrated embodiment, the member connector 122 may include a threaded nut disposed at least partially within a receiver 112 of a first cylinder 104 of the linkage 100, and fixed in place such as by welding the threaded nut to an end of the first cylinder 104.

The linkage 100 in one embodiment includes a spring element 180 operable under tension to urge the first and second linkage couplers 102, 152 toward each other. The spring element 180 in one embodiment may be a coil spring that is preloaded in an operating position. As discussed herein, the operating position may correspond to the position shown in the illustrated embodiment of FIG. 2, with a second stop 160 contacting a first stop 110 to prevent further compression of the spring element 180. The preload of the spring element 180 may be adjusted depending on the application and a target amount of breakaway force applied along the longitudinal axis 101 so that the linkage 100 extends in length.

In an alternative embodiment, one or both ends of the spring element 180 may be coupled directly to a component to which the first or second linkage couplers 102, 152 are coupled. For instance, one end of the spring element 180 may be coupled directly to the plow 210 or the implement support 202. Additionally, or alternatively, the other end of the spring element 180 may be coupled directly to the other of the plow 210 or the implement support 202. If one or neither end of the spring element 180 is connected to the linkage 100, the spring element 180 may be connected and positioned in order to facilitate breakaway action for the linkage 100 similar to one or more embodiments described herein in which both ends of the spring element 180 are coupled to the linkage 100.

As an example, the first linkage coupler 102 and a first end of the spring element 180 may be coupled to the plow 210. A second end of the spring element 180 may be coupled to the second linkage coupler 152. The first end of the spring element 180 and the first linkage coupler 102 may be coupled to the plow 210 proximate to each other, enabling the spring element 180 to allow breakaway action or extension of the linkage 100 by movement of the first linkage coupler 102 relative to the second linkage coupler 152. The spring element 180 under tension may urge the first and second linkage couplers 102, 152 toward each other. Similar operation may be provided in the case where both ends of the spring element 180 are not directly coupled to the first and second linkage couplers 102, 152.

A coil spring of the spring element 180 may be selected based on its spring rate, facilitating movement of the first linkage coupler 102 relative to the second linkage coupler 152 in response to the force applied along the longitudinal axis 101 of the linkage 100. The spring rate in conjunction with the preload of the spring element 180 may affect the amount of displacement permitted by the linkage 100 in response to the force applied along the longitudinal axis 101. The spring characteristics (e.g., preload and spring rate) may also affect the breakaway forced needed to displace the linkage 100 from the primary operating position to a breakaway position.

In the illustrated embodiment, the linkage 100 includes a first elongate member 170, which may include the first linkage coupler 102, first cylinder 104, a projection 106, and the member connector 122. The first cylinder 104 may be square or any type of curved or polygon-shaped cylinder, or a cylinder having a cross-section defined by any combination of curves and lines. The first cylinder 104 may define the receiver 112, which may be an internal space of the first cylinder 104, and configured to accept a shaft 158 of a second elongate member 150 as discussed herein.

The projection 106 in the illustrated embodiment may extend from an outer surface of the first cylinder 104, and include an opening 107 capable of accepting a spring connector 108 for the spring element 180. The spring connector 108 may be adjustable to facilitate changing a preload of the spring element 180 in accordance with a target amount of preload. The spring connector 108 may include a threaded element 130 with a spring receiver 136 capable of accepting a spring coupling 182 (e.g., a spring hook) of the spring element 180. The threaded element 130 may be disposed within the opening 107 and adjusted via the nut 132. By tightening the nut 132 on the threaded element 130, the length between the projection 106 and the spring coupling 182 may be shortened, thereby increasing a preload of the spring element 180. A locking nut 134 may be used to more securely hold the threaded element 130 in place after a preload is set. It is to be understood that although the projection 106 and the spring connector 108 are disposed external to the first cylinder 104, the present disclosure is not so limited. Any one or more of these components may be disposed within the receiver 112 of the first cylinder 104.

In the illustrated embodiment, the linkage 100 includes a second elongate member 150, which may include the second linkage coupler 152, a second cylinder 154, a projection 156, and a shaft 158. The projection 156 in the illustrated embodiment may extend from an outer surface of the second cylinder 154 and include an opening 157. The opening 157 may be operable to accept a spring coupling 184, such as a spring hook, to connect the spring element 180 to the second elongate member 150. It is to be understood that the spring coupling 184 and the projection 156 may be disposed internal to the second elongate member 150 in an alternative embodiment.

The second linkage coupler 152 may be secured to an end of the second cylinder 154, such as by welding the second linkage coupler 152 thereto. As discussed herein, the second linkage coupler 152 may include an opening 153 capable of facilitating connection to a component of a support assembly (e.g., an implement support) or a plow assembly.

In the illustrated embodiment, the second cylinder 154 is a hollow cylinder similar to the first cylinder 104. Likewise, the second cylinder 154 may be a square cylinder, or any type of cylinder such as a polygon-based cylinder or a curved cylinder, or a cylinder having a cross-section with a combination of lines and curves. The shaft 158 may be operable to fit within an internal space of the second cylinder 154 such that an end of the shaft 158 may substantially align with a portion of the second linkage coupler 152 at an end portion of the second cylinder 154. Both the second linkage coupler 152 and the shaft 158 may be secured to the second cylinder 154 proximal to this end of the second cylinder 154. It is noted that the shaft 158 may be secured to the second cylinder 154 in additional or alternative ways. For instance, one or more bolts may be provided through sides of the second cylinder 154 and the shaft 158 in order to secure the shaft 158 to the second cylinder 154.

The cross section of the shaft 158 may be sized to fit within the receiver 112 and to substantially restrain movement in axes other than the longitudinal axis 101 when the linkage 100 is provided in the breakaway position with the shaft 158 partially within the receiver 112. The clearance or gap between the surface of the receiver 112 and the shaft 158 may provide a slip fit between the shaft 158 and the receiver 112. As an example, the gap may be about 0.6" to provide a slip fit—although the gap may vary based on material selection and a target degree of slippage.

As discussed herein, the second elongate member 150 may include a shoulder or second stop 160 defined by an end of the second cylinder 154 in conjunction with the shaft 158. The shoulder may provide a substantially flush engagement surface for engagement of the first stop 110 of the first cylinder 104. This way, as the spring element 180 urges the first and second linkage couplers 102, 152 toward each other after separation, the contact and resulting impact force between the first and second stops 110, 160 can be transferred more uniformly along the length of the first and second elongate members 170, 150 rather than at a single contact point or edge.

In one embodiment, the interface between the first and second stops 110, 160 provides a substantially continuous surface along the exterior of the first and second cylinders 104, 154. However, it is to be noted that the present disclosure is not so limited. The interface may provide a discontinuous, curved, or sloped surface along the exterior of the first and second cylinders 104, 154.

The first and second elongate members 170, 150 are configured to move relative to each other along the longitudinal axis 101. For instance, as the first and second linkage couplers 102, 152 are displaced away from each other, the shaft 158 slides out of the receiver 112. The shaft 158 may only partially slide out of the receiver 112 such that a remaining portion of the shaft 158 that remains within the receiver 112 provides substantial stability for the linkage 100 along the longitudinal axis 101. In one embodiment, the spring element 180 may be operable to substantially prevent extension of the linkage 100 beyond a point at which the shaft 158 no longer provides substantial stability in conjunction with the receiver 112 for the linkage 100. For instance, the spring element 180 may be configured to allow one or two inches of extension or a maximum load determined for the application. The preload may also be set to provide fine-tuned control over the amount of available extension for the linkage 100 for an application.

Figure 4:
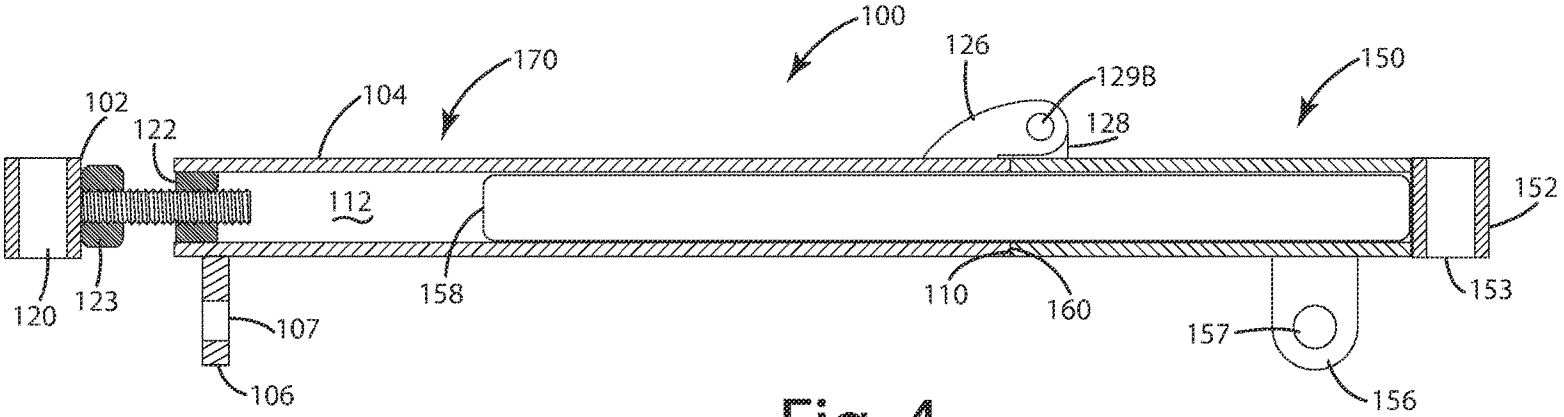
FIG. 4 shows a sectional view of FIG. 2.
Figure 5:
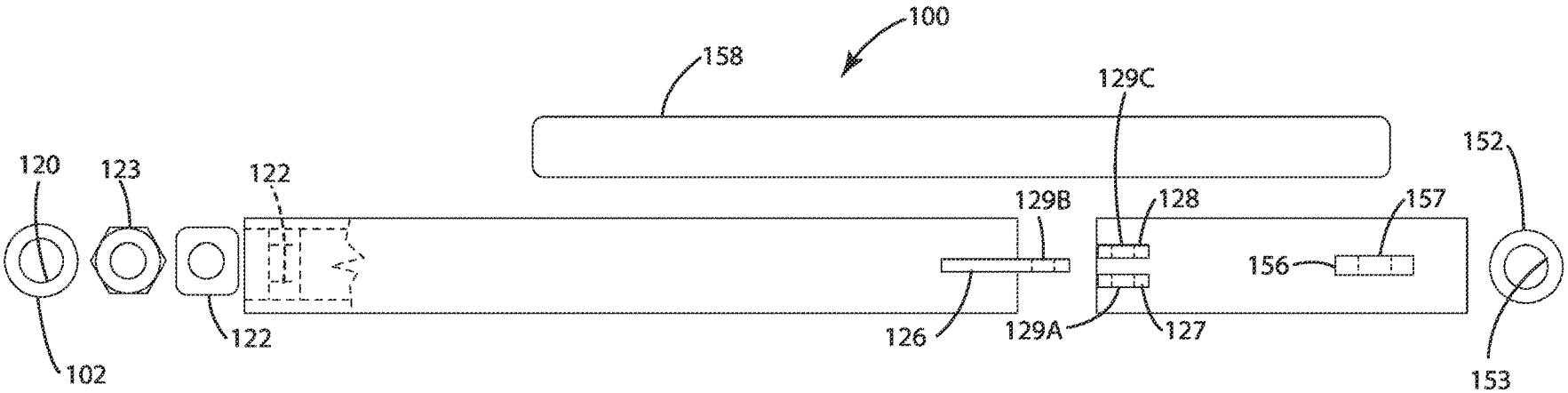
FIG. 5 shows an exploded view of the linkage of FIG. 1.
Figure 6:
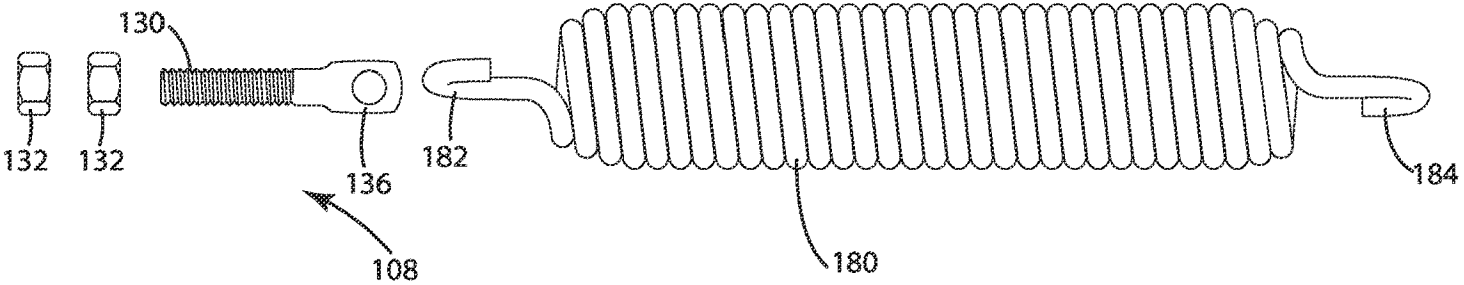
FIG. 6 depicts a spring and a coupling of the linkage in accordance with one embodiment.

In the illustrated embodiments of FIGS. 4 and 5, optional lock receivers 126, 127, 128 are provided for locking the linkage 100 to prevent extension along the longitudinal axis 101 or displacement between the first and second linkage couplers 102, 152. The lock receivers 126, 127, 128 may be disposed on the first and second cylinders 104, 154, and may include openings 129A-C capable of receiving a pin or lock that couples the first and second cylinders 104, 154 together to prevent extension or movement therebetween. It is to be understood that the lock receivers 126, 127, 128 may be configured differently. For example, the lock receivers 126, 127, 128 may take the form of openings through the first cylinder 104 and the shaft 158 to accept a pin or lock and prevent linear motion therebetween.

Figure 7:
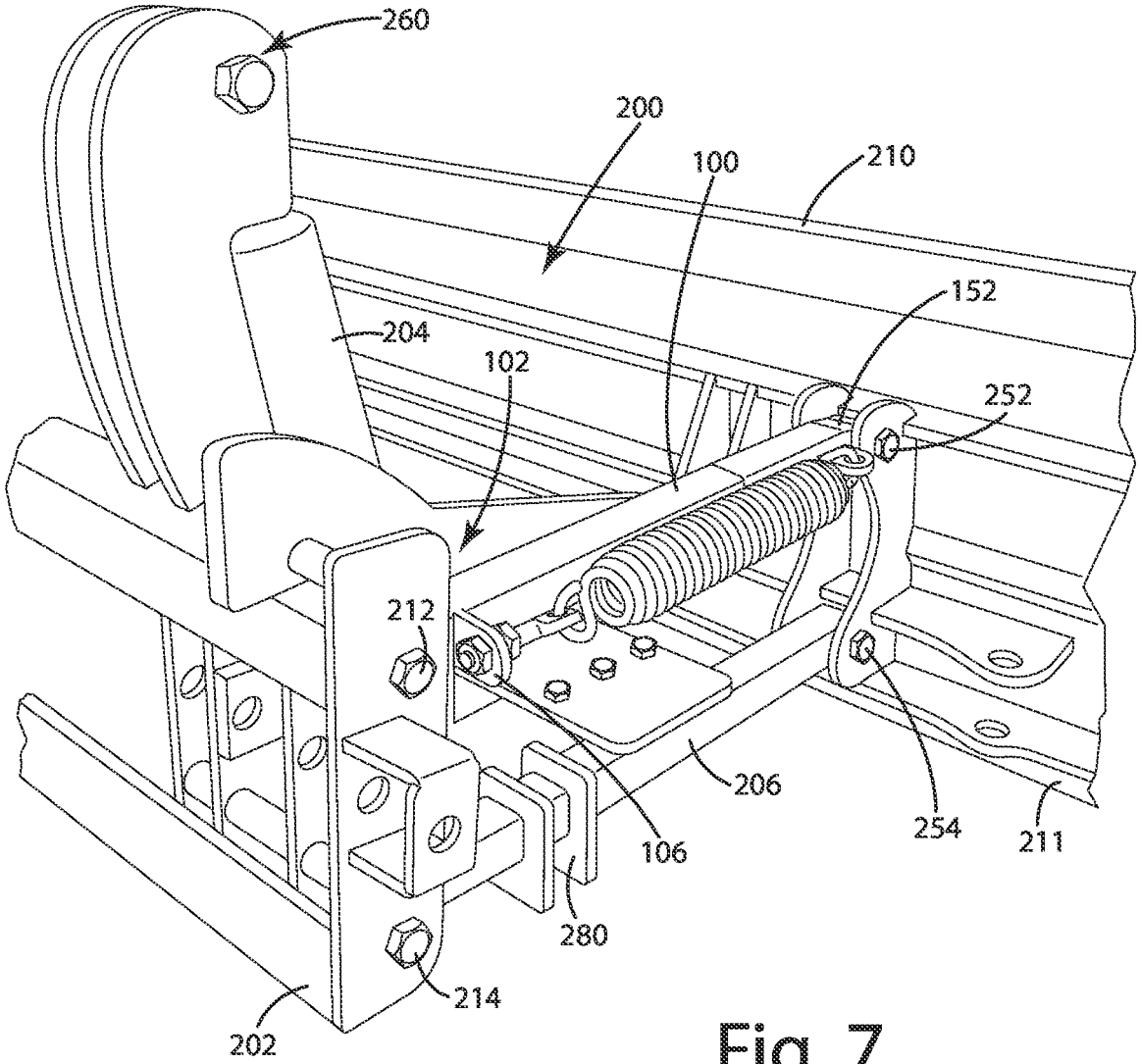
FIG. 7 shows a perspective view of a plow assembly in accordance with one embodiment in conjunction with the linkage of FIG. 1.
Figure 8:
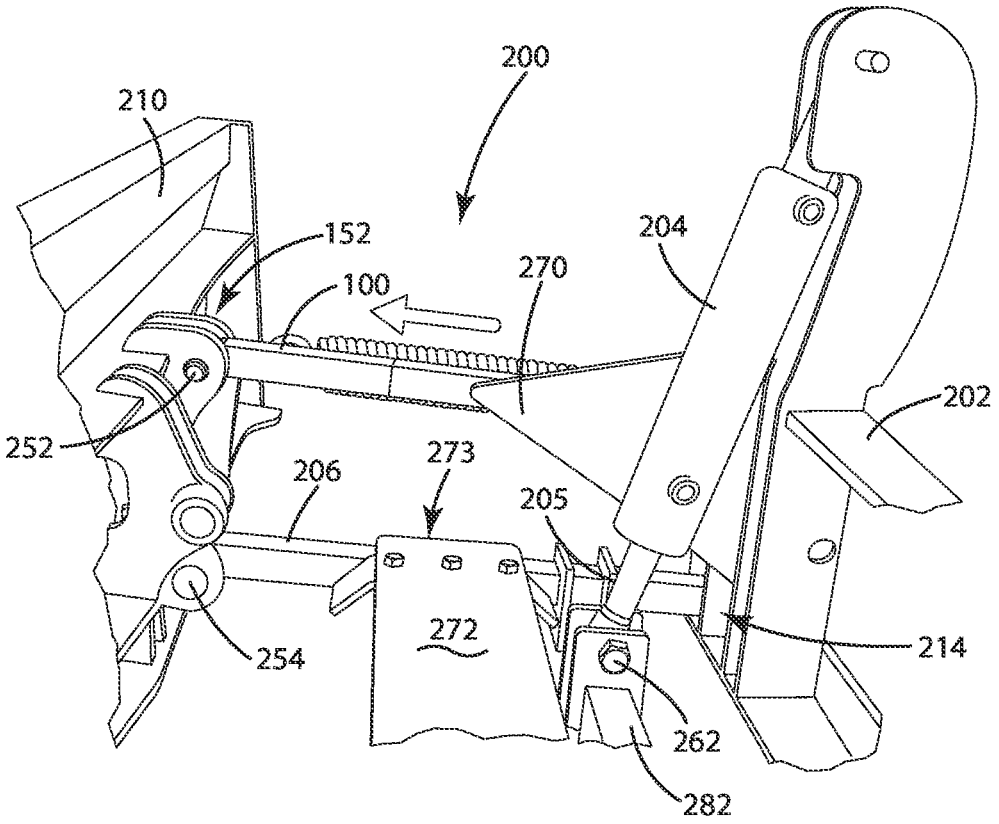
FIG. 8 shows a side view of the plow assembly of FIG. 7.
Figure 9:
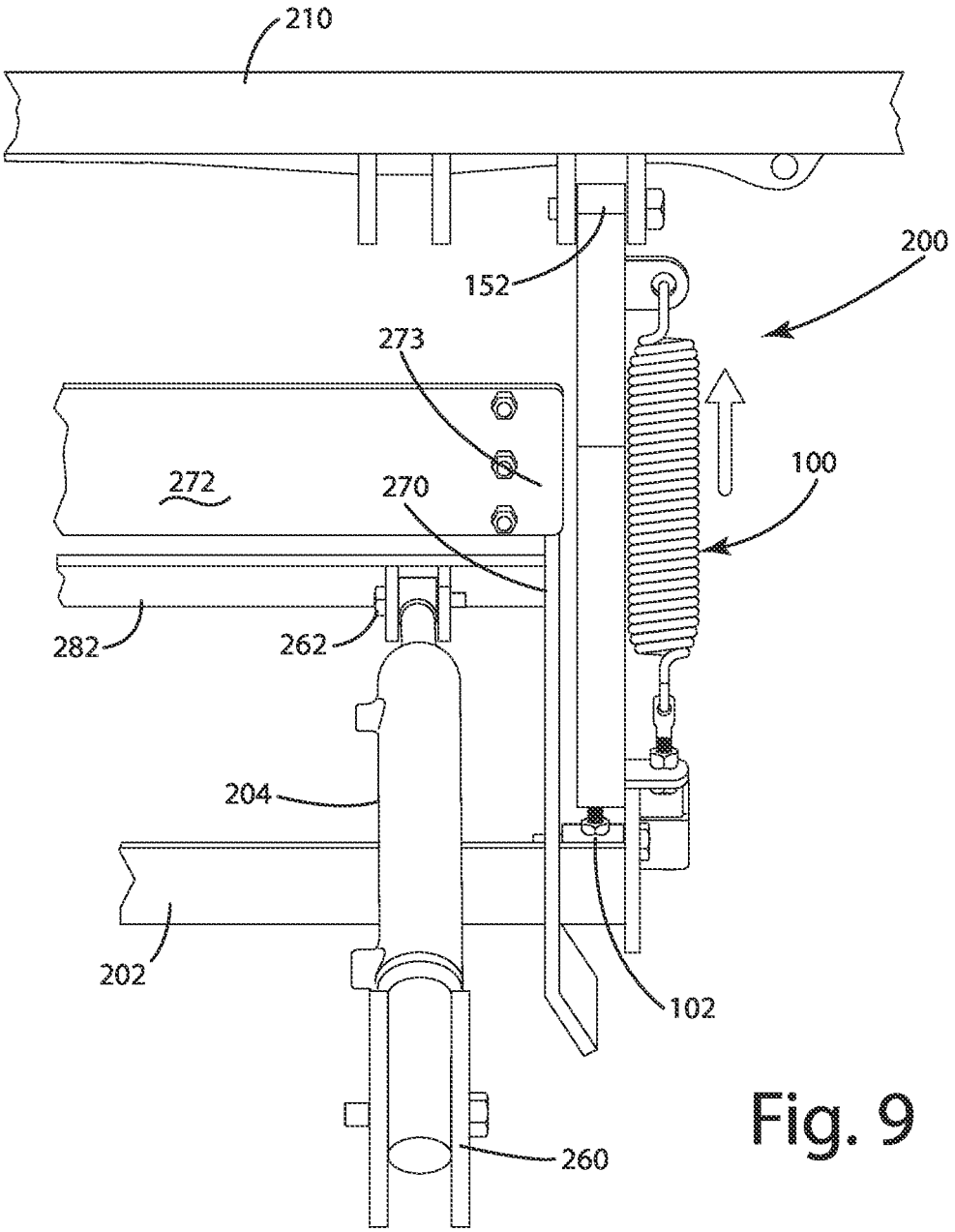
FIG. 9 shows a top view of the plow assembly of FIG. 7.

Turning to FIGS. 7-9, a support assembly 200 for a plow 210 in accordance with one embodiment is depicted. The support assembly 200 may include an implement support 202, which may be coupled to the vehicle via a hitch assembly or directly to the vehicle. Examples of couplings and connections between the implement support 202 and a vehicle are described in U.S. Pat. No. 10,150,428 to Weihl, issued on Dec. 11, 2018, and filed on Feb. 19, 2018, and entitled Adaptable Hitch System—the disclosure of which is hereby incorporated by reference in its entirety.

In the illustrated embodiment, the implement support 202 is configured to permit the plow 210 to pivot in response to encountering an obstruction. The plow 210 in the illustrated embodiment is a rear plow, although it is to be understood the present disclosure is not so limited. The plow 210 may be a front plow for a vehicle, or another type of implement that may be provided in place of the plow 210.

The support assembly 200 in the illustrated embodiment includes a linkage 206, which may be a fixed length, and which may be coupled between the implement support 202 and the plow 210. The linkage 206 may pivot relative to the implement support 202 about the connector 214, and may also pivot relative to the plow 210 about the connector 214. In the illustrated embodiment, the support assembly 200 includes an actuator 204, which may be a hydraulic actuator capable of extending and contracting an actuator arm 205. The actuator 204 may be connected to the implement support 202 at an actuator connector 260, and may be coupled to the linkage 206 via a support member 282. The actuator 204 may be coupled to the support member 282 by a support connector 262. Both the actuator connector 260 and the support connector 262 may enable pivoting or rotation of the actuator 204.

In the illustrated embodiment, contraction of the actuator 204 may result in lifting or raising of the support member 282 relative to a ground surface. This may cause the linkage 206 to rise as well due to the connection 280 between the linkage 206 and the support member 282. The linkage 206 may pivot about the connector 214, raising the connector 254 so that the plow 210 rises.

A stop 270 may be provided on the implement support 202 in one embodiment to engage a stop plate 272 at a contact surface 273. Contraction of the actuator 204 may cause the stop 270 to engage the contact surface 273, thereby providing a solid engagement between the implement support 202 and the linkage 206 (and also the plow 210 via the connector 254).

In the illustrated embodiment, the linkage 206 is provided as a lower linkage between the implement support 202 and the plow 210. The linkage 100 in accordance with one embodiment may be provided as an upper linkage for connection between the implement support 202 and the plow 210. The linkage 100 may be coupled to the implement support 202 at connector 212, and may be coupled to the plow 210 at the plow connection 252.

As described herein, the linkage 100 may be configured to extend in response to an applied force along the longitudinal axis 101 of the linkage 100. In the illustrated embodiment, if the lower edge or blade 211 of the plow 210 encounters an obstruction in use, the plow 210 may apply force to the linkage 100 by pivoting about the linkage 206 and the connector 254. The amount of force applied to the linkage 100 may be related to the amount of force applied to the blade 211 when encountering obstruction as a function of the distance between the connector 212 and the connector 214, the length of the linkage 206 and the length of the linkage 100, and the distance between the connector 254 and the connector 252. For instance, in one embodiment, the distance between the connector 212 and the connector 214 may be approximately eight inches.

In the illustrated embodiment, in response to the blade 211 encountering obstruction of sufficient force, the linkage 100 may extend along its longitudinal axis 101 to allow the blade 211 to move relative to the obstruction, or absorb some of the impact force due to contact with the obstruction. In this way, the blade 211 may move in response to contact with the obstruction and potentially avoid significant damage to the blade 211 that might otherwise occur if the blade 211 were rigidly disposed. As described herein, after the force on the blade 211 has been removed, the linkage 100 may urge the connector 252 toward the implement support 202 to return the linkage to an operating position for both the linkage 100 and the plow 210.

It is noted that, in use, an applied force is provided on the blade 211 to remove or distribute debris, such as snow. The preload and the spring rate of the spring element 180, as well as the placement of the connection between the implement support 202 and the plow 210 may be determined to facilitate extension of the linkage 100 in response to an applied force that is outside or significantly beyond an amount of force encountered by the blade 211 in general use to remove and distribute debris. For instance the breakaway force or trip force applied to the blade 211 to cause extension of the linkage 100 may be based on the amount of the force encountered during use in moving debris.

For purposes of disclosure, the connections and linkages between the implement support 202 and the plow 210 are described in conjunction with the left hand side of the plow assembly. It is to be understood that the right hand side may mirror the left hand side to facilitate similar operation, including the breakaway action or trip action in response to encountering an obstruction.

Figure 10:
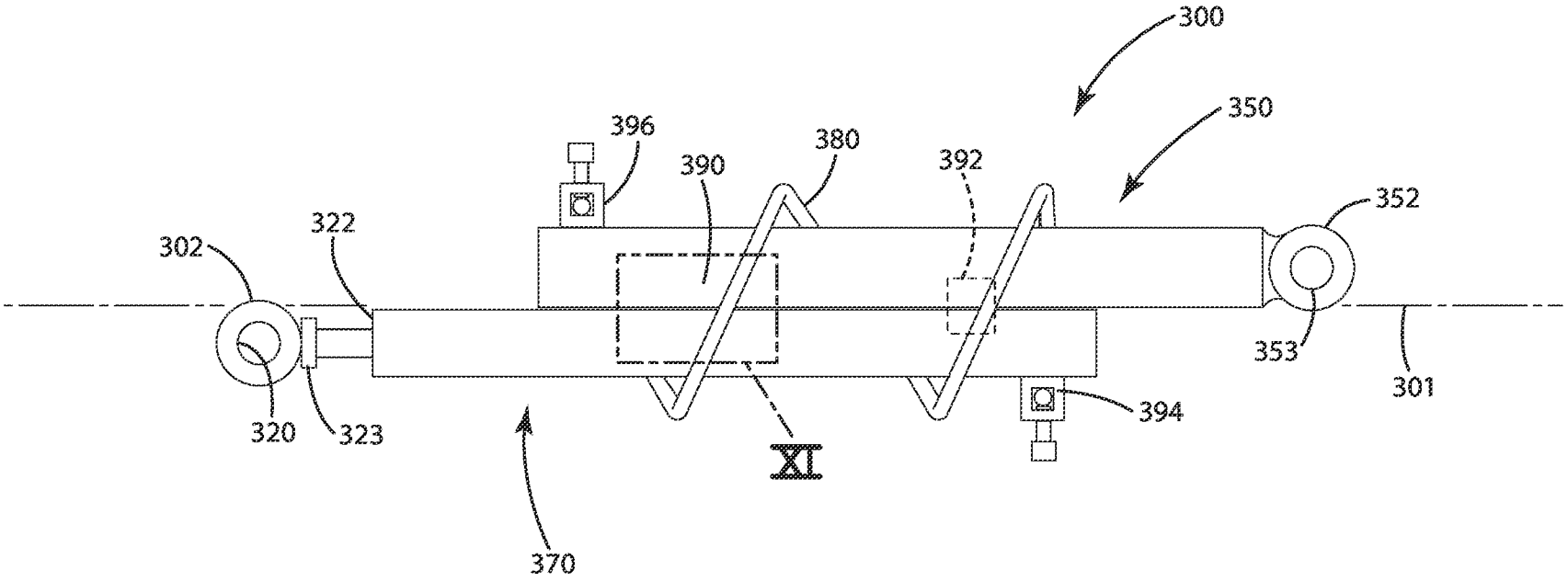
FIG. 10 shows an alternative embodiment of a linkage in accordance with the present disclosure.
Figure 11:
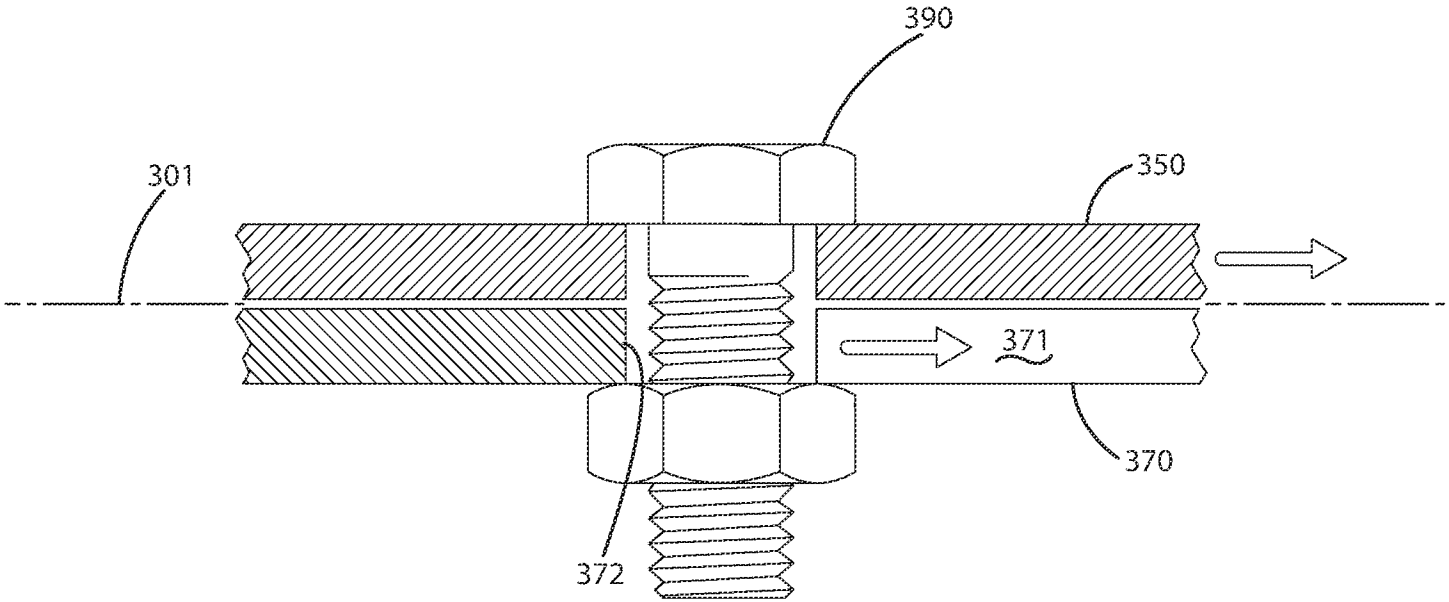
FIG. 11 show an enlarged and sectional view of a portion of the linkage in FIG. 10.

An alternative embodiment of a breakaway arm assembly or linkage is shown FIGS. 10 and 11 and generally designated 300. The linkage 300 is similar to the linkage 100 described herein with several exceptions. For instance, the linkage 300 may provide breakaway action with respect to first and second end portions along the longitudinal axis 301, and may include a spring element 380. However, the spring element 380 of the linkage 300 is configured under compression to urge the first and second end portions toward each other, and to facilitate breakaway action. The linkage 300 may be used in place of the linkage 100 and one or more embodiments described herein, including an embodiment in which the linkage 100 facilitates coupling a support assembly to a plow. The linkage 300 may be configured to provide connection substantially similar to the linkage 100 for such a coupling, and may be configured to provide breakaway action similar to the linkage 100 despite being configured to provide such breakaway action in a different manner from the linkage 100.

The linkage 300 in the illustrated embodiment may include a first linkage coupler 302 disposed proximal to the first end portion, and a second linkage coupler 352 disposed proximal to the second end portion. The first linkage coupler 302 and the second linkage coupler 352 may include openings 320, 353 capable of accepting a pin or other member to facilitate engagement to a corresponding coupler, such as a coupler disposed on a support assembly for a plow or the plow itself, similar to the linkage 100 described herein.

Similar to the first linkage coupler 102 of the linkage 100, the first linkage coupler 302 may be adjustable via a coupler connector 323 and a member connector 322. The adjustable connection may allow rotation of the first linkage coupler 302 relative to a main portion of the linkage 300 in order to align the first linkage coupler 302 with another coupler, such as a plow or a support assembly for the plow. The adjustable connection may facilitate lengthening or shortening the linkage 300 for using linking to external couplers, such as the plow and the support assembly for the plow.

The linkage 300 in the illustrated embodiment includes a first elongate member 370, which may be similar in some respects to the first elongate member 170, including a first linkage coupler 302 and a member connector 322 similar respectively to the first linkage coupler 102 and the member connector 122. The first elongate member 370 in the illustrated embodiment is a cylinder having an internal space operable to accept first and second support 390, 392.

The linkage 300 may also include a second elongate member 350, which may be similar in some respects to the second elongate member 150, such as by including a second linkage coupler 352 similar to the second linkage coupler 152. The second elongate member 350 and the first elongate member 370 may be disposed adjacent to each other in a movable relationship, supported by the first and second supports 390, 392.

As described herein, the first elongate member 370 and the second elongate member 350 may move relative to each other along the longitudinal axis 301. The first and second supports 390, 392 may maintain a lateral position of the first and second elongate members 370, 350 relative to the longitudinal axis 301. In other words, the first and second supports 390, 392 may be configured to prevent displacement of the first and second elongate members 370, 350 along an axis orthogonal to the longitudinal axis 301.

The spring element 380 in the illustrated embodiment is coupled to the first and second elongate members 370, 350 via first and second spring retainers 394, 396. The first spring retainer 394 is connected to the first elongate member 370 at an end opposite the first linkage coupler 302, and the second spring retainer 396 is connected to the second elongate member 350 at an end opposite the second linkage coupler 352. The spring element 380 in conjunction with the first and second spring retainers 394, 396 may be operable under compression to urge the first and second spring retainers 394, 396 away from each other, thereby urging the first linkage coupler 302 toward the second linkage coupler 352. In response to a force applied along the longitudinal axis 301, the spring element 380 may compress further to allow displacement of the first linkage coupler 302 away from the second linkage coupler 352 along the longitudinal axis 301.

The first and second spring retainers 394, 396 in the illustrated embodiment may include an opening operable to accept a portion of the spring element 380, and a set screw operable to hold this captured portion of the spring element 380 within the opening. This way, the first and second spring retainers 394, 396 may rigidly hold the captured portion of the spring element 380 in place relative to the respective first and second elongate members 370, 350.

Turning to the illustrated embodiment of FIG. 11, the first support 390 is shown in further detail in conjunction with aspects of the first and second elongate members 370, 350. The first support 390 and illustrated embodiment is provided in the form of a bolt and nut operable to hold the first and second elongate members 370, 350 in position relative to each other while allowing movement along the longitudinal axis 301. The second elongate member 350 may include an aperture through which the bolt is disposed, and configured to maintain a fixed relationship relative to the position of the bolt. The first elongate member 370, on the other hand, may include a slot 371 that allows movements of the bolt in a direction along the longitudinal axis 301. The slot 371 may be sized to allow movement of the bolt while contacting the nut (or washer) such that the nut slides along a surface of the first elongate member 370 while maintaining both the first elongate member 370 and the second elongate member 350 in a fixed position along an axis orthogonal to the longitudinal axis 301. The slot 371 may also include a stop 372 that operates to prevent the spring element 380 from urging the first and second elongate members 370, 350 toward each other beyond a position corresponding to the stop 372. In other words, the stop 372 may define a position at which the spring element 380, under compression, holds the first and second elongate members 370, 350 when a force below the breakaway threshold force is applied to the first and second linkage coupler 302, 352. In response to application of a force above the breakaway threshold force, the first and second elongate members 370, 350 may move relative to each other along the longitudinal axis 301, such that the bolt of the first support 390 no longer contacts the stop 372 and moves along the slot 371.

With the arrangement of the first and second elongate members 370, 350 and the spring element 380, the linkage 300 in one embodiment may include components at least partially encircled by the spring element 380 or provided within an internal space of the spring element 380. Additionally, or alternatively, the first and second elongate members 370, 350 may provide an overlapping relationship with respect to each other and be configured to move relative to each other along the longitudinal axis 301.

Figure 12:
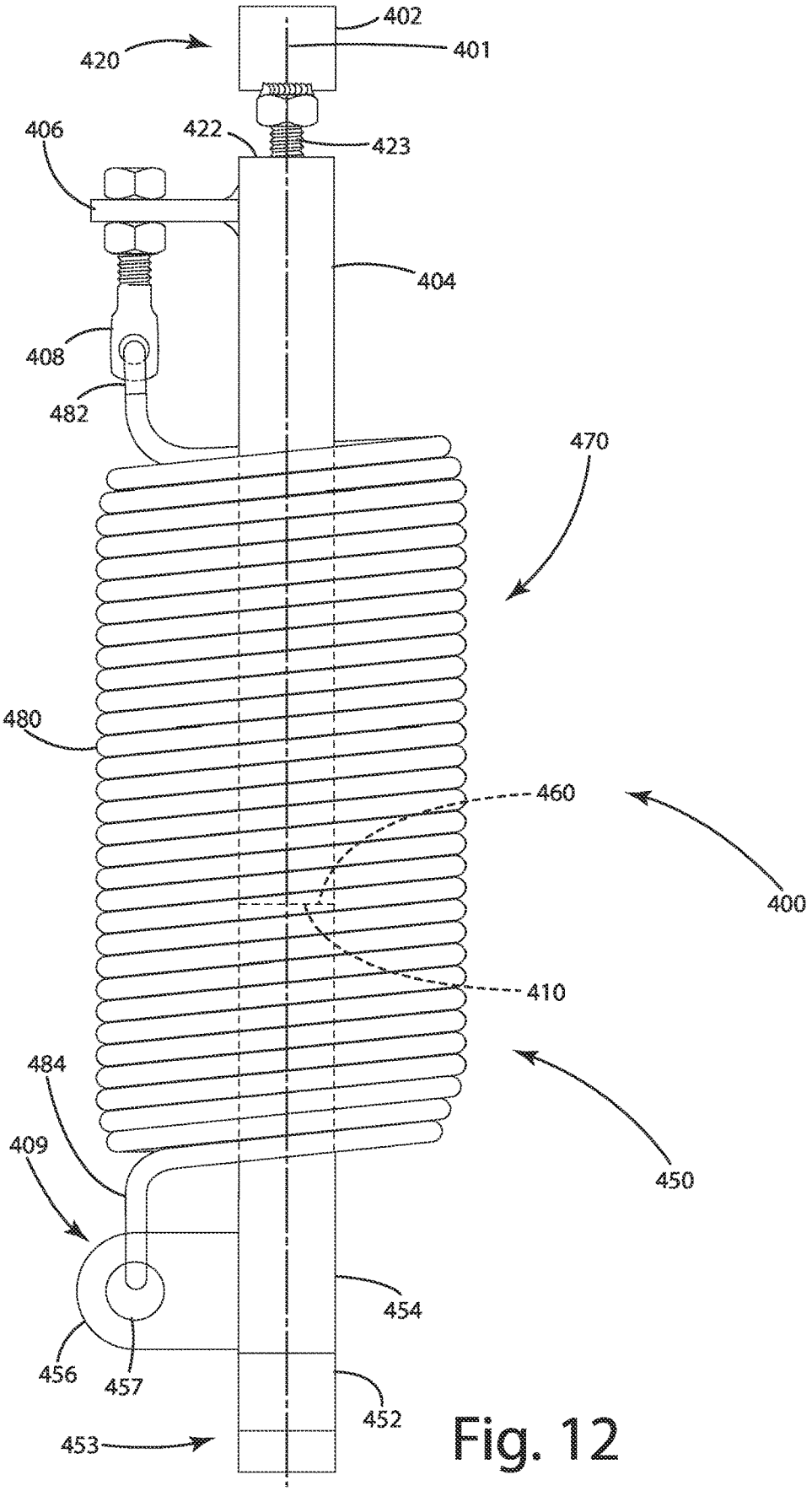
FIG. 12 shows an alternative embodiment of a linkage in accordance with the present disclosure.
Figure 13:
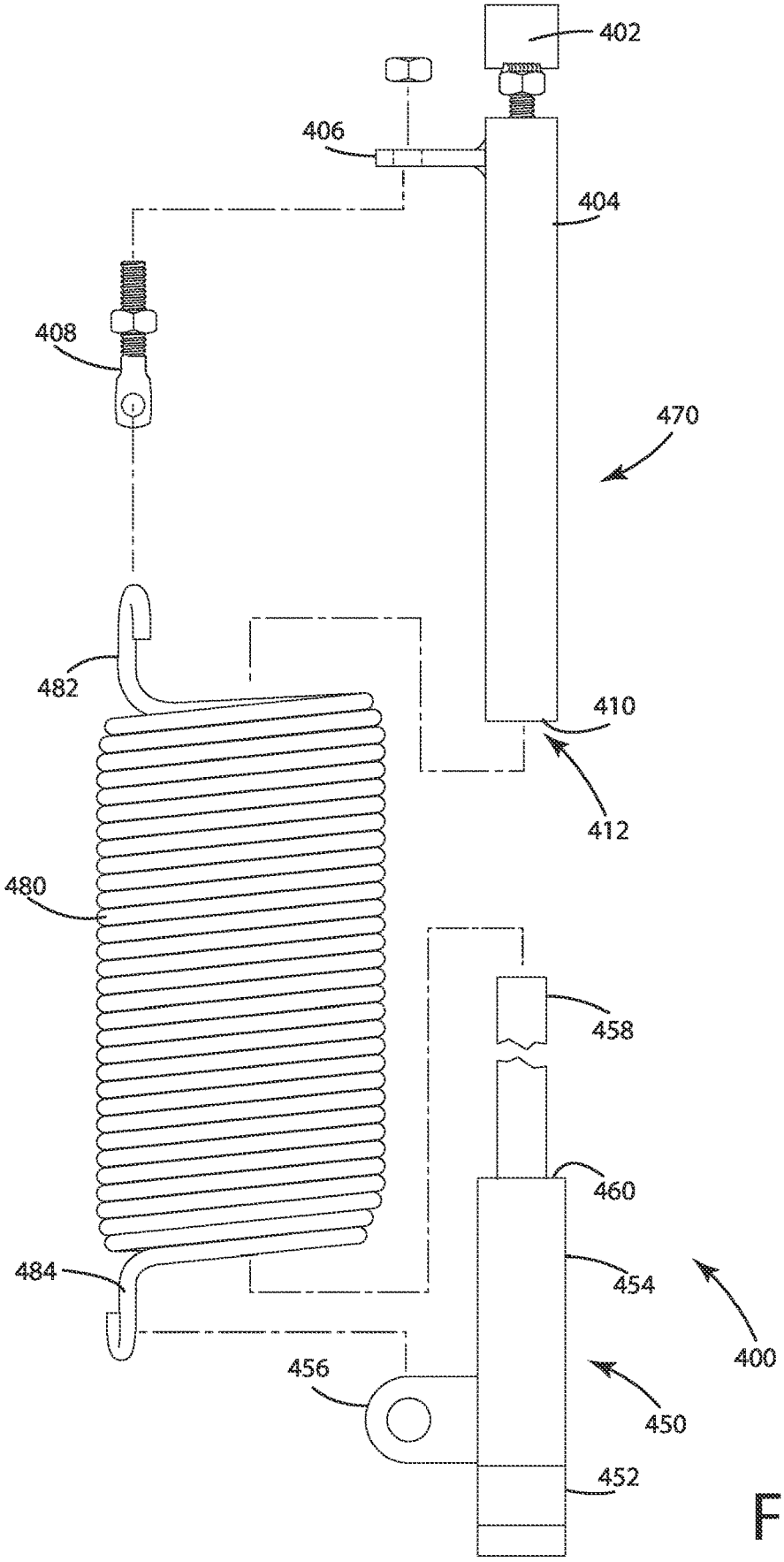
FIG. 13 shows an exploded view of the linkage in FIG. 12.

Another alternative embodiment of a breakaway arm assembly or linkage is shown in FIGS. 12 and 13 and generally designated 400. The linkage 400 is similar to the linkage 100 described herein with several exceptions. For instance, the linkage 400 may provide breakaway action with respect to first and second end portions along the longitudinal axis 401, and may include a spring element 480. The spring element 480 of the linkage 400 is configured to urge the first and second end portions toward each other, and to facilitate breakaway action. The linkage 400 may be used in place of the linkage 100 and one or more embodiments described herein, including an embodiment in which the linkage 100 facilitates coupling a support assembly to a plow. The linkage 400 may be configured to provide a connection substantially similar to the linkage 100 for such a coupling, and may be configured to provide breakaway action similar to the linkage 100, with the spring element 480 operating under tension to urge the first and second end portions toward each other.

The linkage 400 in the illustrated embodiment may include a first linkage coupler 402 disposed proximal to the first end portion, and a second linkage coupler 452 disposed proximal to the second end portion. The first linkage coupler 402 and the second linkage coupler 452 may include openings 420, 453 capable of accepting a pin or other member to facilitate engagement to a corresponding coupler, such as a coupler disposed on a support assembly for a plow or the plow itself, similar to the linkage 100 described herein.

Similar to the first linkage coupler 102 of the linkage 100, the first linkage coupler 402 may be adjustable via a coupler connector 423 and a member connector 422, which is similar to the member connector 122. The adjustable connection may allow rotation of the first linkage coupler 402 relative to a main portion of the linkage 400 in order to align the first linkage coupler 402 with another coupler, such as a plow or a support assembly for the plow. The adjustable connection may facilitate lengthening or shortening the linkage 400 for using linking to external couplers, such as the plow and the support assembly for the plow.

The linkage 400 in the illustrated embodiment includes a first elongate member 470, which may be similar in some respects to the first elongate member 170, including a first linkage coupler 402 and a member connector 422 similar respectively to the first linkage coupler 102 and the member connector 122. The first elongate member 470 in the illustrated embodiment is a cylinder having an internal space or receiver 412 operable to accept a shaft 458.

The linkage 400 may also include a second elongate member 450, which may be similar in some respects to the second elongate member 150, such as by including a second linkage coupler 452 similar to the second linkage coupler 152. The second elongate member 450 and the first elongate member 470 may be disposed adjacent to each other in a movable relationship, supported by the receiver 412 and the shaft 458.

As described herein, the first elongate member 470 and the second elongate member 450 may move relative to each other along the longitudinal axis 401. The receiver 412 and the shaft 458 may maintain a lateral position of the first and second elongate members 470, 450 relative to the longitudinal axis 401.

The spring element 480 in the illustrated embodiment is coupled to the first and second elongate members 470, 450 via a first spring connector 408 and a second spring connector 409 provided by the projection 456 and an opening 457. The first spring connector 408 is connected to the first elongate member 470 proximal to the first linkage coupler 402, and the second spring connector 409 is connected to the second elongate member 450 at an end proximal to the second linkage coupler 452. The spring element 480 in conjunction with the first and second spring connectors 408, 409 may be operable under tension to urge the first and second linkage couplers 402, 452 toward each other. In response to a force applied along the longitudinal axis 401, the spring element 480 may extend to allow displacement of the first linkage coupler 402 away from the second linkage coupler 452 along the longitudinal axis 401.

With the arrangement of the first and second elongate members 470, 450 and the spring element 480, the linkage 400 in one embodiment may include components at least partially encircled by the spring element 480 or provided within an internal space of the spring element 480.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation (s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. A linkage assembly for a plow assembly, said linkage assembly comprising:

a first elongate member including a first linkage coupler, the first linkage coupler operable to join with a first coupler of the plow assembly, the first linkage coupler disposed proximal to a first end of the linage assembly;

a second elongate member including a second linkage coupler, the second linkage coupler operable to join with a second coupler of the plow assembly, the second linkage coupler disposed proximate to a second end of the linkage assembly opposite the first end, wherein the first elongate member includes a shaft portion, wherein the second elongate member includes a receiver portion that receives the shaft portion of the first elongate member, wherein the shaft portion of the first elongate member is operable to slide within the receiver portion of the second elongate member; and a spring element operable under tension to urge the first linkage coupler toward the second linkage coupler to a primary operating position, the spring element operable to permit movement of the first linkage coupler to move relative to the second linkage coupler, wherein the spring element is external and substantially parallel to the first and second elongate members.

2. The linkage assembly of claim 1 wherein the spring element includes first and second ends respectively coupled to the first and second elongate members.

3. The linkage assembly of claim 1 wherein the first and second elongate members are axially aligned and define a longitudinal axis of the linkage assembly, and wherein the spring element permits extension of the linkage assembly along the longitudinal axis.

4. The linkage assembly of claim 1 wherein the spring element is operable to permit extension of the linkage assembly in response to the plow assembly encountering an obstruction, whereby the linkage assembly allows a plow of the plow assembly to move by stretching the spring element under tension.

5. The linkage assembly of claim 1 wherein the first elongate member includes a first projection having a first opening operable to interface with a first end of the spring element, wherein the second elongate member includes a second projection having a second opening operable to interface with a second end of the spring element.

6. The linkage assembly of claim 5 wherein the spring element is disposed between the first and second projections under tension such that the spring element urges the first and second projections toward each other.

7. The linkage assembly of claim 1 wherein the first elongate member includes a shoulder portion adjacent to the shaft portion and operable to contact the second elongate member at the primary operating position, wherein the spring element is under tension at the primary operating position.

8. The linkage assembly of claim 1 wherein the first and second elongate members include first and second lock receivers capable of being locked together at the primary operating position to provide a locked mode for the linkage assembly, and wherein the first and second couplers are prevented from moving relative to each other in the locked mode.

9. A linkage assembly for a plow assembly, said linkage assembly comprising:

a first elongate member including a first linkage coupler, the first linkage coupler operable to join with a first coupler of the plow assembly, the first linkage coupler disposed proximal to a first end of the linkage assembly;

a second elongate member including a second linkage coupler, the second linkage coupler operable to join with a second coupler of the plow assembly, the second linkage coupler disposed proximate to a second end of the linkage assembly opposite the first end, wherein the first elongate member includes a shaft portion, wherein the second elongate member includes a receiver portion that receives the shaft portion, and wherein the shaft portion of the first elongate member is operable to slide within the receiver portion of the second elongate member; and a spring element including first and second spring element ends, the spring element being under tension between the first and second ends to urge the first and second elongate members toward each other, wherein the spring element is external and substantially parallel to the first and second elongate members.

10. The linkage assembly of claim 9 wherein the first and second spring element ends are coupled respectively to the first and second elongate members.

11. The linkage assembly of claim 9 wherein the spring element is operable to urge the first linkage coupler toward the second linkage coupler to a primary operation position, the spring element operable to permit movement of the first linkage coupler to move relative to the second linkage coupler.

12. The linkage assembly of claim 9 wherein the first elongate member includes a shoulder portion adjacent to the shaft portion and operable to contact the second elongate member to maintain the spring element under tension and prevent contraction of the linkage assembly beyond a predetermined length.

13. The linkage assembly of claim 9 wherein the spring element is operable to permit extension of the linkage assembly in response to the plow assembly encountering an obstruction, whereby the linkage assembly allows a plow of the plow assembly to move by stretching the spring element under tension.

* * * * *